US005971315A

United States Patent [19]

Kojo

[11] Patent Number: 5,971,315

[45] Date of Patent: Oct. 26, 1999

[54] METHOD FOR DETERMINING THE QUALITY OF REELING OR WINDING AND FOR CONTROLLING THE REELING OR WINDING

[75] Inventor: Teppo Kojo, Järvenpää , Finland

[73] Assignee: Valmet Corporation, Helsinki, Finland

[21] Appl. No.: 09/106,871

[22] Filed: Jun. 29, 1998

[30] Foreign Application Priority Data

Jun. 30, 1997 [FI] Finland ..... 972811

[51] Int. Cl.[6] ..... B65H 18/08

[52] U.S. Cl. ..... 242/534.2; 242/912

[58] Field of Search ..... 242/534, 534.2, 242/912

[56] References Cited

U.S. PATENT DOCUMENTS

| | | | |
|---|---|---|---|
| 3,854,329 | 12/1974 | Jones . | |
| 3,977,619 | 8/1976 | Nagata et al. | 242/534.2 |
| 4,535,950 | 8/1985 | Lisnyansky | 242/534.2 |
| 4,679,744 | 7/1987 | Chikamasa et al. | 242/534 |
| 4,817,883 | 4/1989 | Hoffmann et al. | 242/534 |
| 4,955,553 | 9/1990 | Noe et al. | 242/534.2 |
| 4,968,386 | 11/1990 | Nguyen | 242/534 |
| 5,308,010 | 5/1994 | Hakiel | 242/534 |
| 5,769,353 | 6/1998 | Juhe et al. | 242/534 |

FOREIGN PATENT DOCUMENTS

| | | | |
|---|---|---|---|
| 0839743 | 5/1998 | European Pat. Off. . | |
| 27 12 772 | 10/1977 | Germany | 242/912 |
| 53-13663 | 2/1978 | Japan | 242/534 |
| 58-63649 | 4/1983 | Japan | 242/534.2 |
| 59-158750 | 9/1984 | Japan | 242/534 |

OTHER PUBLICATIONS

Patent Abstracts of Japan (1 page), Publication No. 06080289, "Vibration Control Method of Winder" Mar. 1994.

Patent Abstracts of Japan (1 page), Publication No. 63267650, "Web Winder" Nov. 1988.

*Primary Examiner*—Donald P. Walsh
*Assistant Examiner*—William A. Rivera
*Attorney, Agent, or Firm*—Steinberg & Raskin, P.C.

[57] ABSTRACT

A method for determining the quality of the formation of a reel or roll of a paper or board web and controlling the reel or roll formation or subsequent processing of the reel or roll based on the determined quality of the formation of the reel or roll. An oscillation signal produced by impulses formed in a web reel or roll during reeling or winding and arising from relative movements of web layers and/or from damaging of the web is measured and optionally stored. The measured signal is stored in electrical form as a function of time, reel/roll diameter, or the length of the web. The stored values are used in the control of the formation of reel or roll or in subsequent unwinding, reeling or winding of the reel or roll.

25 Claims, 4 Drawing Sheets

METHOD FOR DETERMINING THE QUALITY OF REELING OR WINDING AND FOR CONTROLLING THE REELING OR WINDING

FIELD OF THE INVENTION

The present invention relates to methods for determining the quality of the formation of a reel or roll of a paper or board web and for controlling the reel or roll formation or subsequent processing of the reel or roll, e.g., reeling, winding or unwinding. based on the determined quality of formation of the reel or roll.

BACKGROUND OF THE INVENTION

In reeling or winding of paper or other, equivalent web-like material, in the forming of machine reels, a so-called Pope-type reel-up is commonly employed. In a Pope-type reel-up, the paper reel is formed by loading the reel against a Pope drum.

On the other hand, in slitter-winders, in which customer rolls are formed, winders of the drum winder type are commonly used. In a drum winder, there are two winding drums, on whose support the paper roll is formed. The paper roll that is being formed is loaded by means of rider rolls which are brought into contact with the top face of the paper roll. From the drum winder, a winder with a set of belt rolls has been developed further, in which one of the winding drums has been substituted for by two smaller rolls which are surrounded by an endless carrier belt that supports the paper roll. In slitter winders, a center-drive winder is also employed, in which the roll is formed on support of one winding drum so that the roll is constantly supported from its center by means of an adjustable hydraulic support.

When a paper web or equivalent is reeled or wound, it is the primary objective that the web that is formed should be reeled or wound onto the reel or roll as evenly as possible in order that the reel or roll should have a uniform quality in view of enabling and improving further processing. In order that this objective could be achieved, a number of different methods and apparatus have been suggested for controlling the reeling or winding process. In practice, the reeling or winding process can, however, not be controlled completely and in reeling or winding, defects unavoidably arise in some reels or rolls. Since such defects cause problems in the subsequent processing of the reeled or wound material, it would be advantageous if the defective reel or roll, the location of the defect in the reel or roll, and the nature of the defect could be identified right in the stage of reeling or winding.

Predicting a deficiency in the structure arising from reeling or winding and the presence of damage arising from this deficiency in the web is, however, not reliably possible today. For this reason, if it is suspected that, for example, in a line of paper manufacture, in a machine reel, there is bottom damage or other damage, in the unwinding taking place in the next process stage, a sufficiently large bottom portion is allowed to remain so as to be on the safe side. Since bottom damage that results in web breaks generally does not occur systematically in every machine reel, as a result of such a procedure, unnecessary broke, and thus also unnecessary economic losses, arise. Similarly, web damage in customer rolls causes web breaks in the printing machine, which is an undesirable situation from the point of view of the printing operator, because it lowers the efficiency of the printing machine.

Methods of NDT (Non-destructive testing) of machine reels and rolls in general have not been developed very actively, in spite of the necessity of availability of such methods. Research has been carried out, among other things, into tomography and into thermographic analysis. Experiments have provided promising results, but the methods still require a large amount of further development before they are able to be utilized for predicting structural defects in a reel or roll. In particular, for analysis of a machine reel, there are not sufficiently large tomographic apparatus, and the cost would probably constitute an obstacle for development of such apparatus. Thermography is restrictive in the sense that the examination is carried out by depicting the surface or the end of the reel or roll. In such a case, the results are based on observation of the difference in temperature arising from movements between layers of paper and produced by friction heat, which does not state very precisely where and what sorts of reeling or winding defects have arisen. Further, the stability of the emission coefficient of the paper, for example, in situations of pressing, is not known.

With respect to thermographic analysis, reference is made to International Publication No. WO 95/27676, in which a method is described by whose means the higher temperature of a defective point in a reel or roll is measured by means of a thermograph. Thus, thermal radiation is measured here. Thermal radiation, i.e., infrared radiation, is electromagnetic radiation, which is transmitted by every object whose temperature is above the absolute zero point. Thermal rays move at the speed of light. The intensity of the radiation depends on the temperature of the object and on the wave length of the radiation. With the exception of a fully black object, every object also reflects and absorbs radiation coming from other sources. Defects in a reeling or winding process are converted to heat, for example, by the effect of friction, which slows down, equalizes and weakens the interdependence between the impulse and the signal and thus, makes the method deficient.

When a customer roll or a machine reel becomes larger, in the reeling or winding situation various bangs and creaks are often heard, which arise from relative movements of layers of paper in the roll or reel. These sounds are also observed in situations of braking and acceleration of a roll or reel. The human ear cannot detect from where the sounds arise and what is more precisely taking place in the interior of the roll or reel. Sounds arising from life in the reel are indicative of changes taking place in the structure of the machine reel. Sounds in a certain frequency range indicate the formation of a detrimental reeling or winding defect.

OBJECTS AND SUMMARY OF THE INVENTION

It is an object of the present invention to provide new and improved methods for determining the quality of the formation of a reel or roll of a paper or board web and for controlling the reel or roll formation based on the determined quality of formation of the reel or roll.

It is an object of the present invention to provide new and improved methods for determining the quality of the formation of a reel or roll of a paper or board web and for controlling subsequent processing of the reel or roll based on the determined quality of the formation of the reel or roll.

In order to achieve these objects and others, in the method in accordance with the invention, an oscillation signal produced by impulses formed in a web reel or roll during reeling or winding and arising from relative movements of web layers and/or from damaging of the web is measured and preferably stored. The quality of a reel or roll is determined by analyzing the signal from the reel or roll produced by impulses arising in connection with reeling or winding, or with unwinding, from relative movements of web layers and/or from damaging of the web. This signal is measured either by means of measurement fully free of contact or by means of measurement with contact. In contact-free measurement, the sound-frequency signal emitted by the impulses in the air is measured, e.g., by detectors out of contact with the frame constructions of the reel-up or winder. In measurement with contact, the signal of oscillation produced by the impulses in the mechanical parts, i.e., the frame components, of the reel-up or winder is measured. On the basis of the signal produced by the impulses and arising from the reel or roll in connection with reeling or winding, it is directly possible to change the regulation parameters of reeling or winding during the reeling or winding (i.e., during the formation of the reel or roll) or during subsequent processing of the reel or roll (reeling, winding or unwinding), such as the linear load, the profiling of the linear load, the center torque and/or the web tension. As to the first case, as soon it can be concluded on the basis of the signal that some sort of a disturbance is about to arise in the reeling or winding, one or more regulation parameters in the reeling or winding is/are altered, in which case, the disturbance can be eliminated completely or its effect can at least be reduced.

Thus, the present invention involves the utilization of mechanical oscillation (mechanical oscillation and sound) in the papermaking process. The sound consists of wave motion. A sound wave propagates in a medium, based on an interaction of atoms and molecules, both as a longitudinal wave and as a transverse wave. In a gaseous medium, such as air, wave motion is, however, always longitudinal. A sound that propagates by the intermediate of air consists of longitudinal mechanical oscillation of air molecules, variations in pressure that have received the impulse at the interface between air and solid matter from mechanical oscillation of solid matter. Thus, within the scope of the idea of the present invention, it is possible that, besides the mechanical oscillation applied by the impulses in the frame constructions, it is also possible to utilize the longitudinal wave motion (oscillation in the air) in the air produced by the same mechanical oscillation, i.e., a sound-frequency signal. The impulses in a reeling or winding process produce an immediate impulse as a sound and as an impulse of mechanical oscillation applied to the frame components or constructions, in which case, the method in accordance with the present invention permits very quick reactions to defects that arise.

The information that represents the quality of the reel or roll and that was determined on the basis of the signal in connection with reeling or winding can also be used in connection with subsequent unwinding. In unwinding, it is known if the reel or roll is free from defects and, if the reel or roll is not free from defects, it is known precisely in which locations in the reel or roll any deficiencies are present and the nature of the deficiencies. In this manner, it is possible to utilize a maximum proportion of the reel or roll, and any allowance for broke, to be on the safe side, is avoided.

Thus, the analysis takes place mainly in connection with reeling/winding and unwinding, but, for example, out of a machine reel, it is also possible to analyze signals in a storage situation in which the reel is rotated slowly.

By means of the construction in accordance with the invention, it is possible to automate a system of predicting reeling or winding defects based on an analysis of a sound frequency signal propagating in the air or based on an analysis of an oscillation signal propagating in solid matter. The information obtained through a detector mounted on a reel-up, a slitter-winder or on some other apparatus for unwinding or reeling/winding is processed in digital form, and by making use of, for example, self organized charts or some other, equivalent method, formation of reeling/winding defects is predicted. A similar method is utilized, for example, in analyzing the breathing sound of a human being. First, a sufficient number of reeling/winding processes and their web-break data are instructed to the self-organized chart, after which the system is capable of concluding the occurrence of defects on the basis of what it has learnt.

It is an advantage of the invention that the analysis can be carried out directly in connection with the process of manufacture without in any way disturbing the process itself or its running. If contact-free measurement is used, the analysis can be carried by means of one detector, for example a microphone, and by means of the information on the time of formation of the sound and/or by means of data on the diameter of the reel or roll, without the necessity of monitoring the precise location of formation of the sound by means of a number of microphones.

The reference with which the collected information is compared is, for example, the sound produced by a bottom defect, a sound connected with problems of tightness of the reel or roll, a sound related to defects in the surface of paper, or any other, equivalent indicator related to the quality of the reel or roll. This requires an unambiguous and clear method of monitoring reeling/winding defects in order that the data on reeling/winding defects that are fed into the system are expressly data arising from reeling/winding defects and not, for example, arising from torn edges or similar external matters.

In analyzing the information obtained from impulses related to reeling/winding defects, the procedure must be such that it is first determined at what frequencies the reel or roll emits the impulses in order that it is known what frequency bands are analyzed. This takes place so that the desired reels or rolls are analyzed. At the same time, it is ascertained what types of detectors and filtrations and other possible processing must be used in order that the impulses from the reel or roll related to reeling/winding defects can be separated from the background noise. In this connection, it must also be taken into account that reeling/winding defects are of different types for different paper grades because of their different stock compositions, so that the collection of reference data must be carried out separately for each paper grade. The impulses emitted by a reel or roll may also involve differences arising from the line of manufacture, so that this must also be taken into account when reference data is collected.

When storing the oscillation signal, or an analysis of the same, the oscillation signal is stored in electrical form as a function of time, a diameter of the reel or roll or a web length of the reel or roll. Guideline set values for the regulation parameters may then be determined as a function of time, a diameter of the reel or roll or a web length of the reel or roll by means of the stored oscillation signal or the analysis of the oscillation signal.

In some embodiments, set values of the regulation parameters used during the reeling or winding are stored in electrical form as a function of time, a diameter of the reel or roll or a web length of the reel or roll, and any changes made to the set values of the regulation parameters are also stored in electrical form as a function of time, a diameter of the reel or roll or a web length of the reel or roll. As such, guideline set values for the regulation parameters may be determined as a function of time, a diameter of the reel or roll or a web length of the reel or roll by means of the stored set values of the regulation parameters used during the reeling or winding and any stored changes made to the set values of the regulation parameters. The oscillation signal or an analysis thereof may also be stored along with set values of the regulation parameters used during the reeling or winding in parallel with one another. In this case, guideline set values for the regulation parameters are determined as a function of time, a diameter of the reel or roll or a web length of the reel or roll by means of the stored set values of the regulation parameters used during the reeling or winding, any stored changes made to the set values of the regulation parameters and the stored oscillation signal or the analysis of the oscillation signal.

The present invention may be used in conjunction with unwinding of the reel or roll, in which case, properties of the reel or roll during unwinding thereof are stored in electrical form as a function of time, a diameter of the reel or roll or a web length of the reel or roll. Set values of the regulation parameters used during the reeling or winding are also stored in electrical form as a function of time, a diameter of the reel or roll or a web length of the reel or roll, any changes made to the set values of the regulation parameters are stored in electrical form as a function of time, a diameter of the reel or roll or a web length of the reel or roll, and the oscillation signal or an analysis of the oscillation signal and the set values of the regulation parameters used during the reeling or winding may be stored in parallel with one another. Guideline set values for the regulation parameters may then be determined as a function of time, a diameter of the reel or roll or a web length of the reel or roll by means of the stored set values of the regulation parameters used during the reeling or winding, any stored changes made to the set values of the regulation parameters, the stored oscillation signal or the analysis of the oscillation signal and stored properties of the reel or roll during unwinding thereof The invention will be described in detail with reference to some preferred embodiments of the invention illustrated in the figures in the accompanying drawings. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
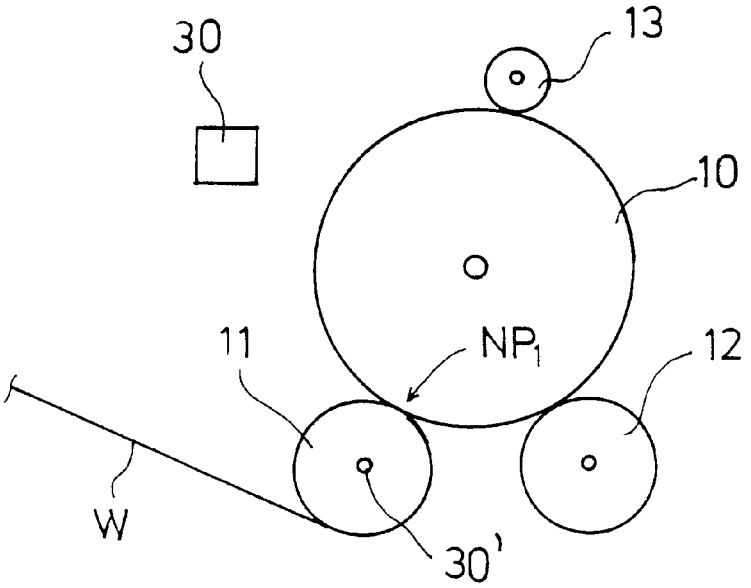
FIG. 1 is a schematic illustration of a drum winder in which the method in accordance with the invention is applied.

Referring to the drawings wherein corresponding reference numerals refer to the same or similar elements, FIG. 1 shows a typical drum winder suitable for the formation of customer rolls, which winder comprises a first winding drum 11 and a second winding drum 12, on which a paper roll 10 is formed. Rider rolls 13 (only one of which is shown) load the paper roll 10. In this exemplifying embodiment, a paper web W or equivalent enters onto a lower face of the first winding drum 11, from which it is transferred onto the paper roll 10 along the face of the first winding drum 11 through a nip $NP_1$, formed by the first winding drum 11 and the paper roll 10.

Figure 2:
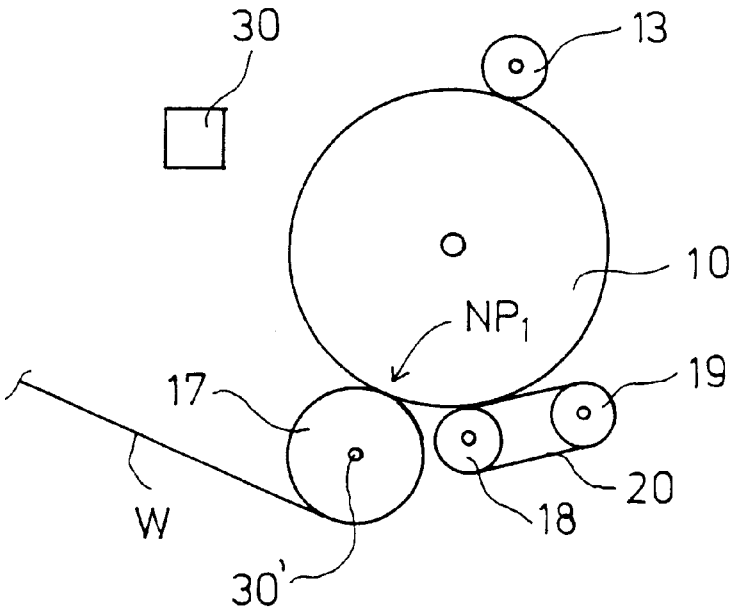
FIG. 2 shows a winder with belt rolls, which is a variation of a drum winder, in which the method in accordance with the invention is applied.

FIG. 2 shows a winder with a set of belt rolls, which is a modification of a drum winder. In this winder with a set of belt rolls, there is also a first winding drum 17, but the second winding drum has been substituted by a paper roll support construction comprising two rolls 18,19 and an endless carrier belt 20 that surrounds the rolls 18,19. Rider rolls 13 (only one of which is shown) load the paper roll 10.

Figure 3:
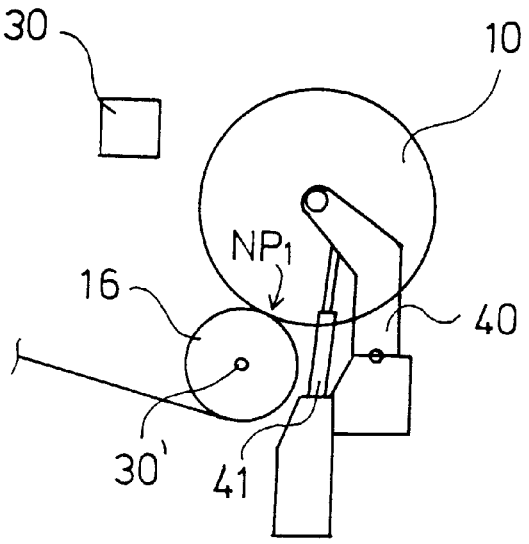
FIG. 3 is a schematic illustration of a center-drive winder in which the method in accordance with the invention is applied.

FIG. 3 shows a center-drive winder in which the web W arrives on a lower face of a winding drum 16, from which it is transferred onto the paper roll 10 through a nip $NP_1$, formed between the winding drum 16 and the paper roll 10. The paper roll 10 is supported from its center by means of support arms 40, which can be regulated by means of hydraulic cylinders 41.

Figure 4:
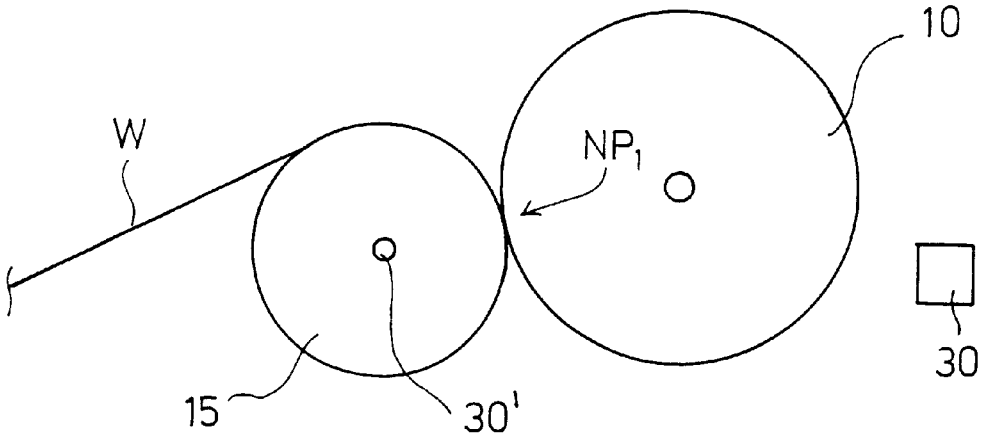
FIG. 4 is a schematic illustration of a Pope-type reel-up in which the method in accordance with the invention is applied.

FIG. 4 shows a Pope-type reel-up suitable for formation of machine reels and comprising a reeling drum 15 onto which the paper web W is passed and from which the web is transferred onto the paper roll 10 through the nip $NP_1$ formed between the reeling drum 15 and the paper reel that is being formed.

Figure 5:
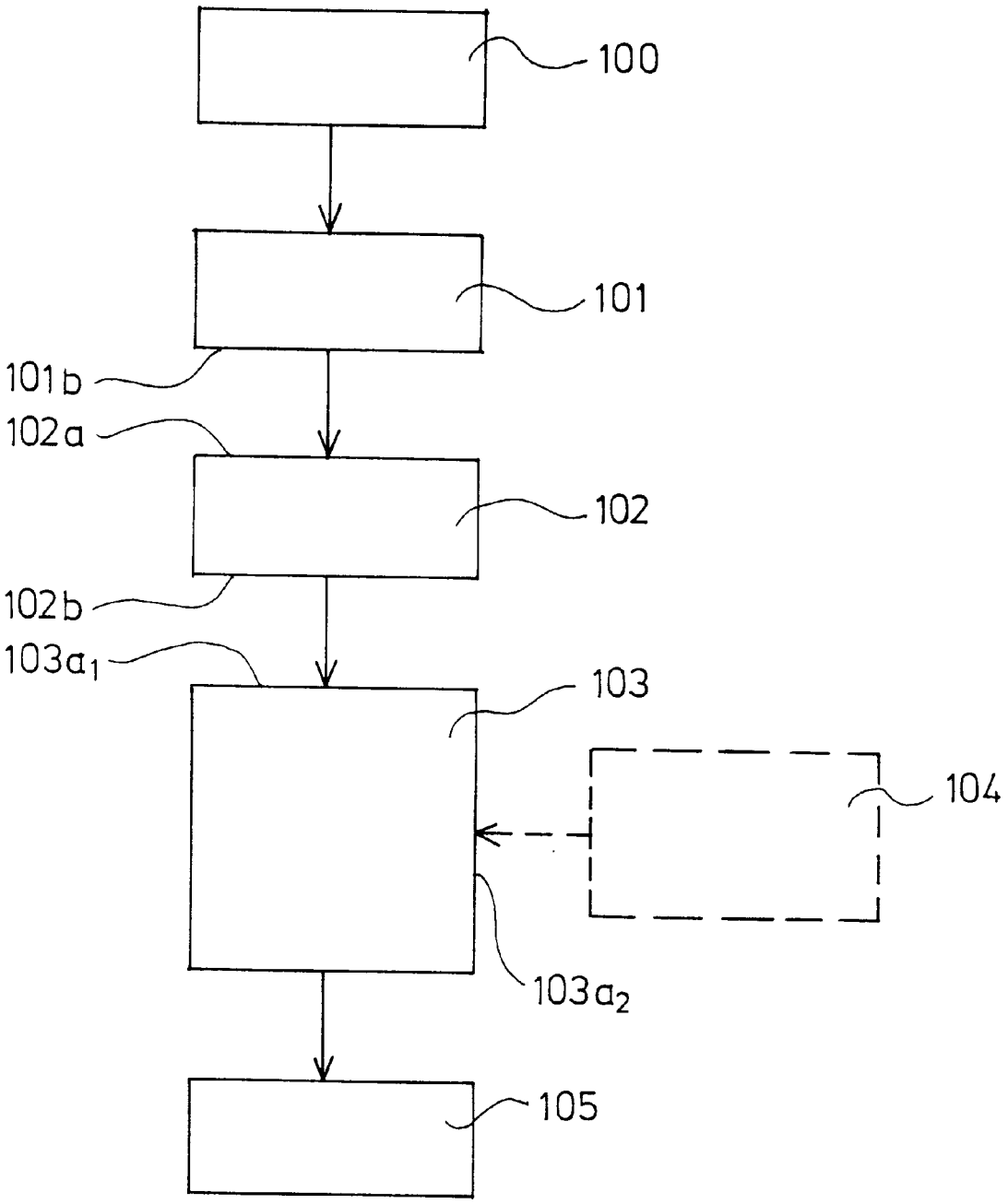
FIG. 5 shows a process diagram of a method in accordance with the invention.

In all of the reeling/winding devices shown in FIGS. 1–4, a detector 30 can be placed, for example, in the vicinity of the paper reel/roll 10 that is formed and/or, for example, at a center of the reeling/winding drum 11, 15, 16, 17 (where the detector is designated 30') or in some other suitable location in the reeling/winding device. The number of detectors 30, 30' that are needed is at least one, but there may be several detectors, in which case they are preferably placed in different locations in the vicinity of the paper reel/roll that is being formed. If contact-free measurement of sound information is concerned, the detector can be placed freely in the vicinity of the reeling/winding device, but an oscillation measurement detector with contact must be attached to a mechanical or structural part of the reeling/winding device such as a frame component thereof FIG. 5 illustrates a block diagram of the method in accordance with the invention. Reference numeral 100 represents the reeling/winding process proper from which the signal produced by the impulses arising from relative movements of web layers and/or from damaging of the web is collected. Reference numeral 101 represents a detector which converts the signal produced by the impulses into an electric signal. If measurement of sound information is concerned, a microphone is employed as the detector, and if oscillation measurement is concerned, an oscillation detector is employed. An analog electric signal is generated by the detector 101. The analog electric signal that contains the sound information and that is obtained from an output port 101*b* of the detector 101 is passed further to an input port 102*a* of an analog to digital (AD) converter 102. In the AD converter 102, the analog signal is converted into a digital signal and passed further into a first input port $\mathbf{103}a_1$, of a computer 103 or other microprocessor. In the computer 103, the signal in the digital form is compared with the self-organized chart, which contains history information on reeling/winding processes. On the basis of the comparison of the digital signal to the history chart, the computer produces the quality report of the reeling/winding by means of an output producing apparatus 105. The information obtained from the new reeling/winding process is also fed into the computer 103 as an addition to the existing history data, in which connection the computer 103 "learns" more all the time. An AD converter may also be integrated in the detector 101, in which case the detector 101 produces a digital signal directly as an output signal, and a separate AD converter 102 is, thus, not needed.

In FIG. 5, the procedure related to the feed of starting data necessary in connection with the introduction of the method is represented by reference numeral 104. When a method of the sort described above is taken into use for the first time, the starting data must first be input into the self-organized chart of the computer. This takes place so that a signal produced by impulses arising from relative movements of web layers and/or from damaging of the web is collected from a relatively large number of reels/rolls, from which defects are analyzed in connection with the collecting and/or later. When measurement is carried out, the information collected based on the signal and the proceeding of the reeling/winding of the web to be reeled/wound must be synchronized in order that it is known to what location in the reel/roll each item of information refers. When the complete reels/rolls have been analyzed in connection with reeling/winding and/or with subsequent unwinding, the defective points in each roll and the related signals can be interrelated. This information is then fed as starting data into the self-organized chart of the computer to a second input port 103$a_2$ of the computer. In this way, a learning process is concerned, in which the computer is "taught" with what criteria it has to identify different defects in the reeling/winding.

Information collected concerning reeling/winding defects can also be utilized directly as a control parameter for regulation of the control of reeling/winding, for example, for regulation of the linear load, the profiling of the linear load, the center torque and/or the web tension. The information collected concerning reeling/winding defects can also be utilized in connection with subsequent process stages in connection with unwinding of the reel/roll. In such a case, it is known if the reel/roll is free from defects, and if it is not free from defects, it is known at which locations there are defects and the nature of the defects.

The information collected by means of the methods in accordance with the invention can also be utilized in the control of the process of manufacture of the material, for example paper, that is concerned at each particular time, i.e., in the regulation/control of preceding parts/actuators in the paper machine. Based on information of a failure in the reel-up/winder, what can be concerned is, for example, regulation of profiles of thickness, moisture, basis weight, tension, fiber orientation, or equivalent both in the cross direction of the machine and in the machine direction.

As an example, it can be stated that a so-called smiling thickness profile produces bottom defects in a machine reel, which defects are expressed as sharp bangs during the reeling as well as layers projecting a few millimeters from the reel edge. In such a case, based on these bangs, it is possible to adjust the thickness profile or at least to give the alarm concerning a deficient profile, in which case, due action can be taken in order to correct the profile.

Thus, in the analyzing proper, a process is concerned in which, on one hand, abnormalities are looked for when good rolls and bad rolls are compared with each other, and, on the other hand, typical features of a bad roll are also looked for.

Figure 6:
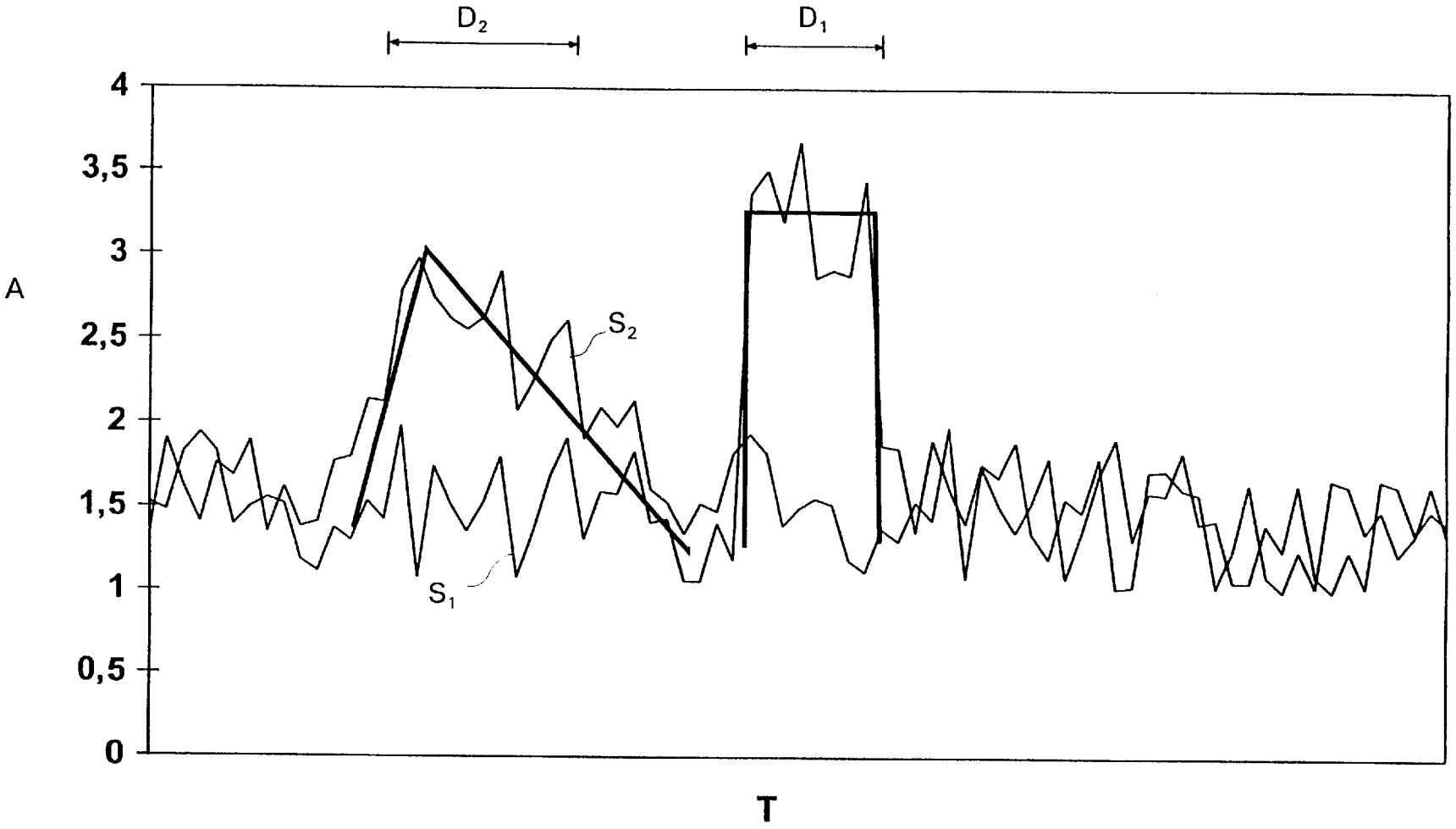
FIG. 6 illustrates the amplitude of an oscillation signal as a function of time.

FIG. 6 illustrates the amplitudes A of two different oscillation signals $S_1$ and $S_2$ as a function of time T. The amplitude has been scaled in the range 0 to 4. The oscillation signal $S_1$. has a point $D_1$, that indicates a reeling/winding defect, has very steep sides, and is clearly distinguished from the background noise, and, similarly, the oscillation signal $S_2$ has a point $D_2$ that indicates a reeling/winding defect and rises and goes down less steeply. What is concerned is a fictitious example of what the impulses that indicate reeling/winding defects could be like.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. A method for determining the quality of the formation of a reel or roll of a paper or board web, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, the step of measuring the oscillation signal comprising the step of measuring a sound-frequency signal emitted by the impulses into the air without contacting the web, and storing the oscillation signal.

2. The method of claim 1, further comprising the step of:

arranging a detector out of contact with frame constructions of a reeling device in which the web is being reeled or a winding device in which the web is being wound to measure the sound-frequency signal.

3. The method of claim 1, wherein the step of storing the oscillation signal comprises the step of storing the oscillation signal or an analysis of the oscillation signal in electrical form as a function of time, a diameter of the reel or roll or a web length of the reel or roll.

4. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, the step of measuring the oscillation signal comprising the step of measuring a sound-frequency signal emitted by the impulses into the air without contacting the web, and controlling the formation of the reel or roll or subsequent reeling, winding or unwinding of the web based on the measured oscillation signal.

5. The method of claim 4, further comprising the step of:

arranging a detector out of contact with frame constructions of a reeling device in which the web is being reeled or a winding device in which the web is being wound to measure the sound-frequency signal.

6. The method of claim 4, further comprising the steps of:

storing the oscillation signal, and using the stored oscillation signal to control subsequent reeling, winding or unwinding of the reel or roll.

7. The method of claim 6, wherein the step of storing the oscillation signal comprises the step of storing the oscillation signal or an analysis of the oscillation signal in electrical form as a function of time, a diameter of the reel or roll or a web length of the reel or roll.

8. The method of claim 6, wherein the step of controlling the formation of the reel or roll or subsequent reeling, winding or unwinding of the web based on the measured oscillation signal comprises the step of controlling regulation parameters of the subsequent reeling, winding or unwinding of the web based on the measured oscillation signal, further comprising the step of:

determining guideline set values for the regulation parameters as a function of time, a diameter of the reel or roll or a web length of the reel or roll by means of the stored oscillation signal.

9. The method of claim 4, wherein the step of controlling the formation of the reel or roll or subsequent reeling, winding or unwinding of the web based on the measured oscillation signal comprises the step of controlling regulation parameters of the subsequent reeling, winding or unwinding of the web based on the measured oscillation signal, further comprising the steps of:

storing set values of the regulation parameters used during the reeling or winding in electrical form as a function of time, a diameter of the reel or roll or a web length of the reel or roll, and storing any changes made to the set values of the regulation parameters in electrical form as a function of time, a diameter of the reel or roll or a web length of the reel or roll.

10. The method of claim 9, further comprising the step of:

determining guideline set values for the regulation parameters as a function of time, a diameter of the reel or roll or a web length of the reel or roll by means of the stored set values of the regulation parameters used during the reeling or winding and any stored changes made to the set values of the regulation parameters.

11. The method of claim 9, further comprising the step of:

storing the oscillation signal or an analysis of the oscillation signal and set values of the regulation parameters used during the reeling or winding in parallel with one another.

12. The method of claim 11, further comprising the step of:

determining guideline set values for the regulation parameters as a function of time, a diameter of the reel or roll or a web length of the reel or roll by means of the stored set values of the regulation parameters used during the reeling or winding, any stored changes made to the set values of the regulation parameters and the stored oscillation signal or the analysis of the oscillation signal.

13. The method of claim 4, further comprising the steps of:

unwinding the reel or roll, and storing properties of the reel or roll during unwinding thereof in electrical form as a function of time, a diameter of the reel or roll or a web length of the reel or roll.

14. The method of claim 13, wherein the step of controlling the formation of the reel or roll or subsequent reeling, winding or unwinding of the web based on the measured oscillation signal comprises the step of controlling regulation parameters of the subsequent reeling, winding or unwinding of the web based on the measured oscillation signal, further comprising the steps of:

storing set values of the regulation parameters used during the reeling or winding in electrical form as a function of time, a diameter of the reel or roll or a web length of the reel or roll, storing any changes made to the set values of the regulation parameters in electrical form as a function of time, a diameter of the reel or roll or a web length of the reel or roll, and storing the oscillation signal or an analysis of the oscillation signal and set values of the regulation parameters used during the reeling or winding in parallel with one another.

15. The method of claim 14, further comprising the step of:

determining guideline set values for the regulation parameters as a function of time, a diameter of the reel or roll or a web length of the reel or roll by means of the stored set values of the regulation parameters used during the reeling or winding, any stored changes made to the set values of the regulation parameters, the stored oscillation signal or the analysis of the oscillation signal and stored properties of the reel or roll during unwinding thereof.

16. The method of claim 4, wherein the step of controlling the formation of the reel or roll or subsequent reeling, winding or unwinding of the web based on the measured oscillation signal comprises the step of controlling regulation parameters of the formation of the reel or roll based on the measured oscillation signal.

17. The method of claim 4, wherein the step of controlling the formation of the reel or roll or subsequent reeling, winding or unwinding of the web based on the measured oscillation signal comprises the step of controlling regulation parameters of the subsequent reeling, winding or unwinding of the web based on the measured oscillation signal.

18. The method of claim 17, wherein the regulation parameters are controlled during unwinding based on the measured oscillation signal.

19. A method for determining the quality of the formation of a reel or roll of a paper or board web, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, the step of measuring the oscillation signal comprising the steps of arranging a detector at a center of a reeling drum in a reeling device in which the web is reeled and over which the web passes or at a center of a winding drum in a winding device in which the web is being wound and over which the web passes, and measuring mechanical oscillations in frame constructions of the reeling device or the winding device resulting from the impulses by means of the detector, and storing the oscillation signal.

20. A method for determining the quality of the formation of a reel or roll of a paper or board web, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, and storing the oscillation signal or an analysis of the oscillation signal in electrical form as a function of time, a diameter of the reel or roll or a web length of the reel or roll.

21. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, the step of measuring the oscillation signal comprising the steps of arranging a detector at a center of a reeling drum in a reeling device in which the web is reeled and over which the web passes or at a center of a winding drum in a winding device in which the web is being wound and over which the web passes, and measuring mechanical oscillations in frame constructions of the reeling device or the winding device resulting from the impulses by means of the detector, and controlling the formation of the reel or roll or subsequent reeling, winding or unwinding of the web based on the measured oscillation signal.

22. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, storing the oscillation signal or an analysis of the oscillation signal in electrical form as a function of time, a diameter of the reel or roll or a web length of the reel or roll, and using the stored oscillation signal, controlling the formation of the reel or roll or subsequent reeling, winding or unwinding of the web.

23. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, storing the oscillation signal, using the stored oscillation signal, controlling the formation of the reel or roll or subsequent reeling, winding or unwinding of the web, the step of controlling the formation of the reel or roll or subsequent reeling, winding or unwinding of the web comprising the step of controlling regulation parameters of the subsequent reeling, winding or unwinding of the web based on the stored oscillation signal, and determining guideline set values for the regulation parameters as a function of time, a diameter of the reel or roll or a web length of the reel or roll by means of the stored oscillation signal or the analysis of the oscillation signal.

24. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, controlling the formation of the reel or roll or subsequent reeling, winding or unwinding of the web based on the measured oscillation signal, the step of controlling the formation of the reel or roll or subsequent reeling, winding or unwinding of the web based on the measured oscillation signal comprising the step of controlling regulation parameters of the subsequent reeling, winding or unwinding of the web based on the measured oscillation signal, storing set values of the regulation parameters used during the reeling or winding in electrical form as a function of time, a diameter of the reel or roll or a web length of the reel or roll, and storing any changes made to the set values of the regulation parameters in electrical form as a function of time, a diameter of the reel or roll or a web length of the reel or roll.

25. A method for determining the quality of the formation of a reel or roll of a paper or board web, and controlling the reel or roll formation or subsequent reeling, winding or unwinding of the reel or roll based on the determined quality of the formation of the reel or roll, comprising the steps of:

reeling or winding the web to form the reel or roll, measuring an oscillation signal produced by impulses formed in the reel or roll during the reeling or winding of the web and arising from at least one of relative movements of web layers and damaging of the web, the oscillation signal being indicative of the quality of the formation of the reel or roll, unwinding the reel or roll, controlling the formation of the reel or roll or subsequent reeling, winding or unwinding of the reel or roll based on the measured oscillation signal, and storing properties of the reel or roll during unwinding thereof in electrical form as a function of time, a diameter of the reel or roll or a web length of the reel or roll.

* * * * *

UNITED STATES PATENT AND TRADEMARK OFFICE

CERTIFICATE OF CORRECTION

PATENT NO. : 5,971,315

DATED : October 26, 1999

INVENTOR(S) : Teppo KOJO

It is certified that error appears in the above-identified patent and that said Letters Patent is hereby corrected as shown below:

On the title page next to [54], the title should read:

--METHOD FOR DETERMINING THE QUALITY OF REELING OR WINDING AND CONTROLLING REELING, WINDING OR UNWINDING OF THE REEL OR ROLL BASED THEREON--

Signed and Sealed this

Sixteenth Day of May, 2000

*Attest:*

Q. TODD DICKINSON

*Attesting Officer*

*Director of Patents and Trademarks*